US007484492B2

(12) United States Patent
Shiraoya et al.

(10) Patent No.: US 7,484,492 B2
(45) Date of Patent: Feb. 3, 2009

(54) FOUR-CYCLE INTERNAL COMBUSTION ENGINE AND VEHICLE

(75) Inventors: Takehiko Shiraoya, Shizuoka (JP); Yasuyuki Hamanaka, Shizuoka (JP); Akira Takeda, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/773,238

(22) Filed: Jul. 3, 2007

(65) Prior Publication Data

US 2008/0006239 A1 Jan. 10, 2008

(30) Foreign Application Priority Data

Jul. 6, 2006 (JP) ..... 2006-187272

(51) Int. Cl.
*F02N 3/00* (2006.01)
*F01L 3/00* (2006.01)

(52) U.S. Cl. ..... 123/188.9; 123/188.12; 123/188.17

(58) Field of Classification Search ..... 123/188.9, 123/188.12, 188.13, 188.17
See application file for complete search history.

(56) References Cited

U.S. PATENT DOCUMENTS

| | | | | |
|---|---|---|---|---|
| 1,191,658 | A * | 7/1916 | Brown | 123/90.65 |
| 2,005,089 | A * | 6/1935 | Krebs | 123/188.13 |
| 4,470,383 | A * | 9/1984 | DeBolt | 123/90.65 |

FOREIGN PATENT DOCUMENTS

| | | | |
|---|---|---|---|
| JP | 59-173510 | * | 10/1984 |
| JP | 03-087905 | | 4/1991 |
| JP | 4-134109 | * | 5/1992 |

* cited by examiner

*Primary Examiner*—Noah Kamen
(74) *Attorney, Agent, or Firm*—Hogan & Hartson LLP

(57) ABSTRACT

A four-cycle internal combustion engine with a valve system having improved durability in the case of high revolution speed. The engine includes a cylinder head having a port, and a valve having a stem part continuous with a fillet part for opening or closing the port. A valve spring including inner and outer springs urges the valve in a direction to close the port. A valve guide holds the stem part slidably. A tubular spring guide supports an outer periphery part of an outer spring to prevent lateral deformation of the spring. A top end of the spring guide is positioned above a top end of a valve guide.

11 Claims, 5 Drawing Sheets

[FIG. 1]
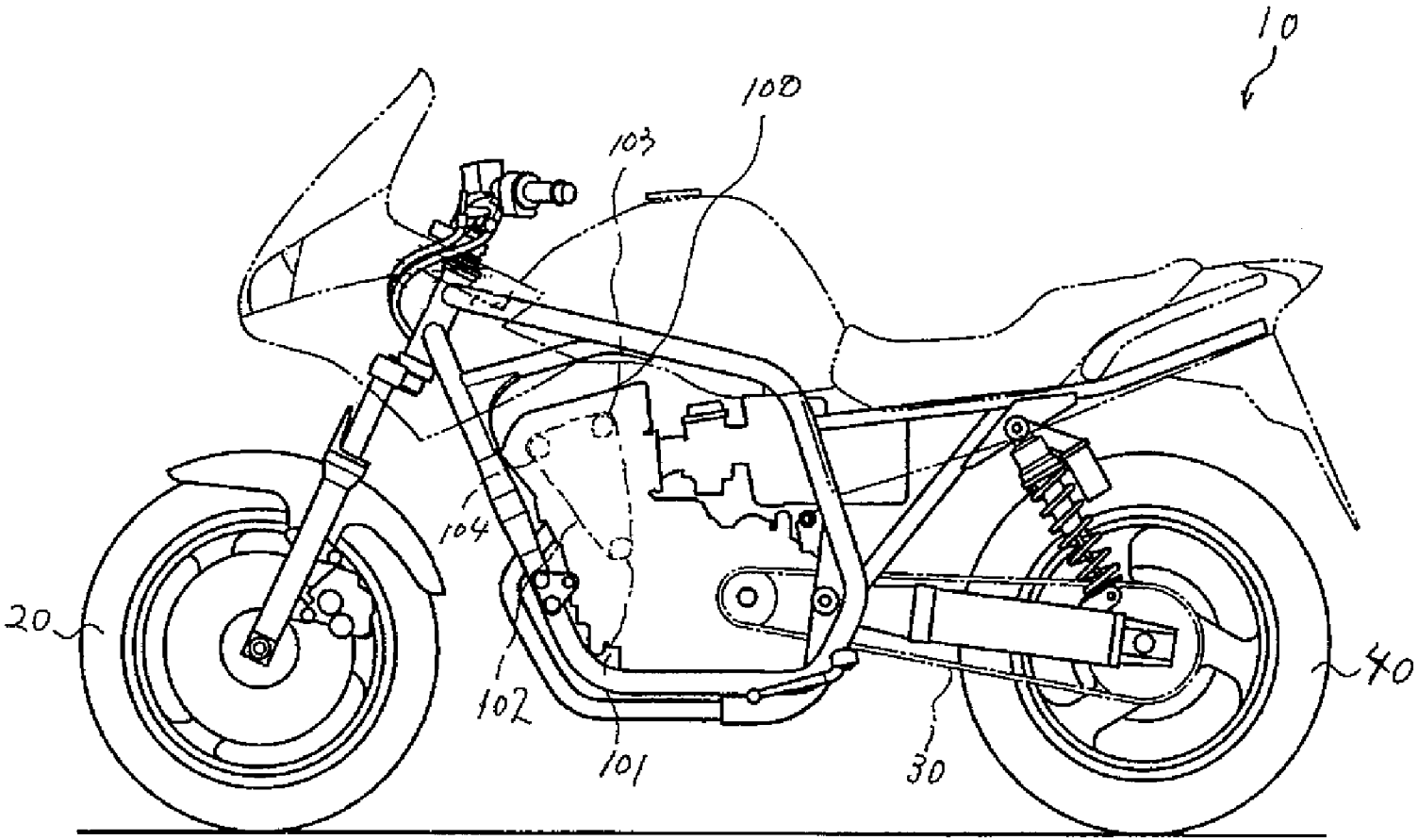

[FIG. 2]
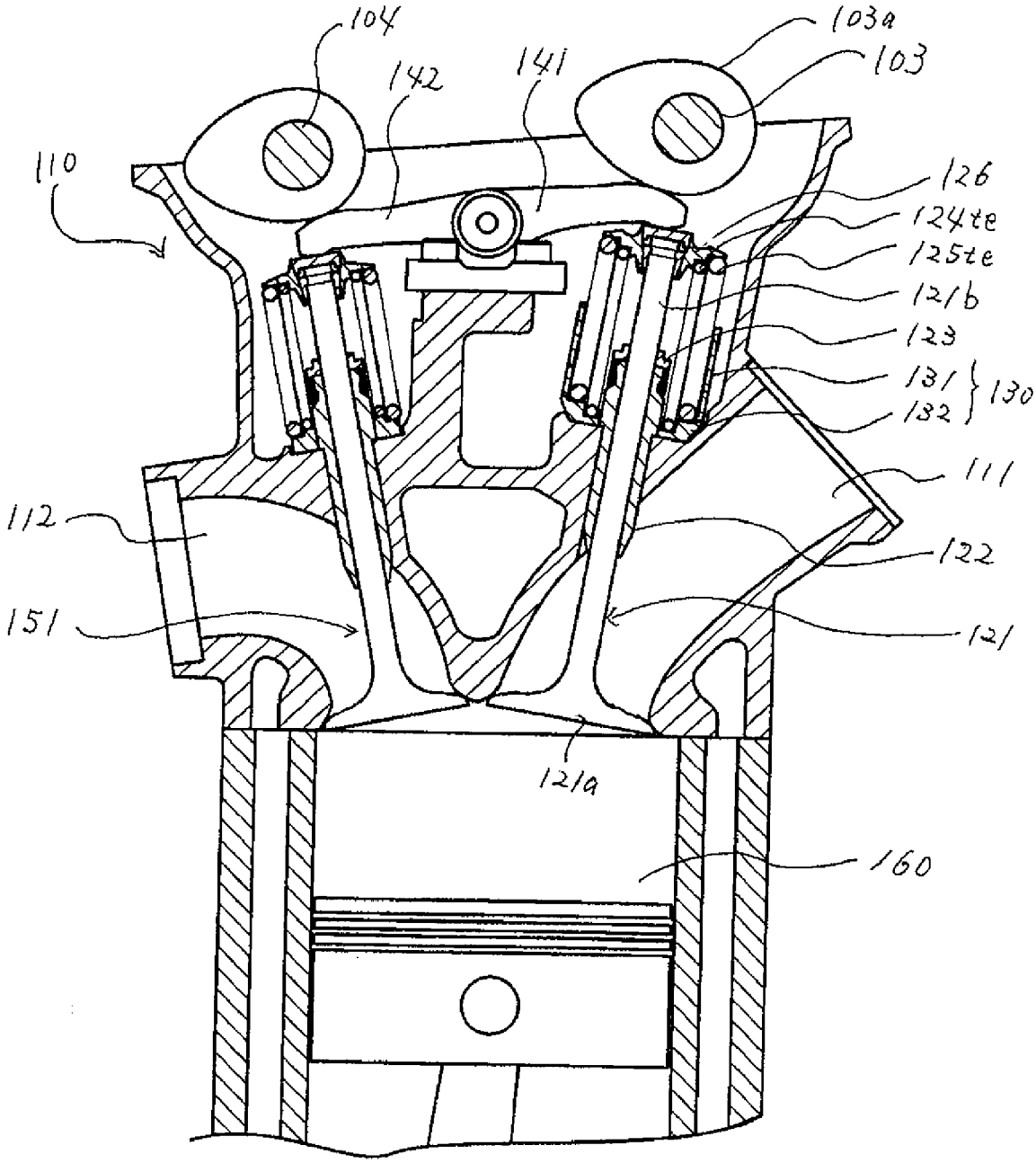

[FIG. 3]
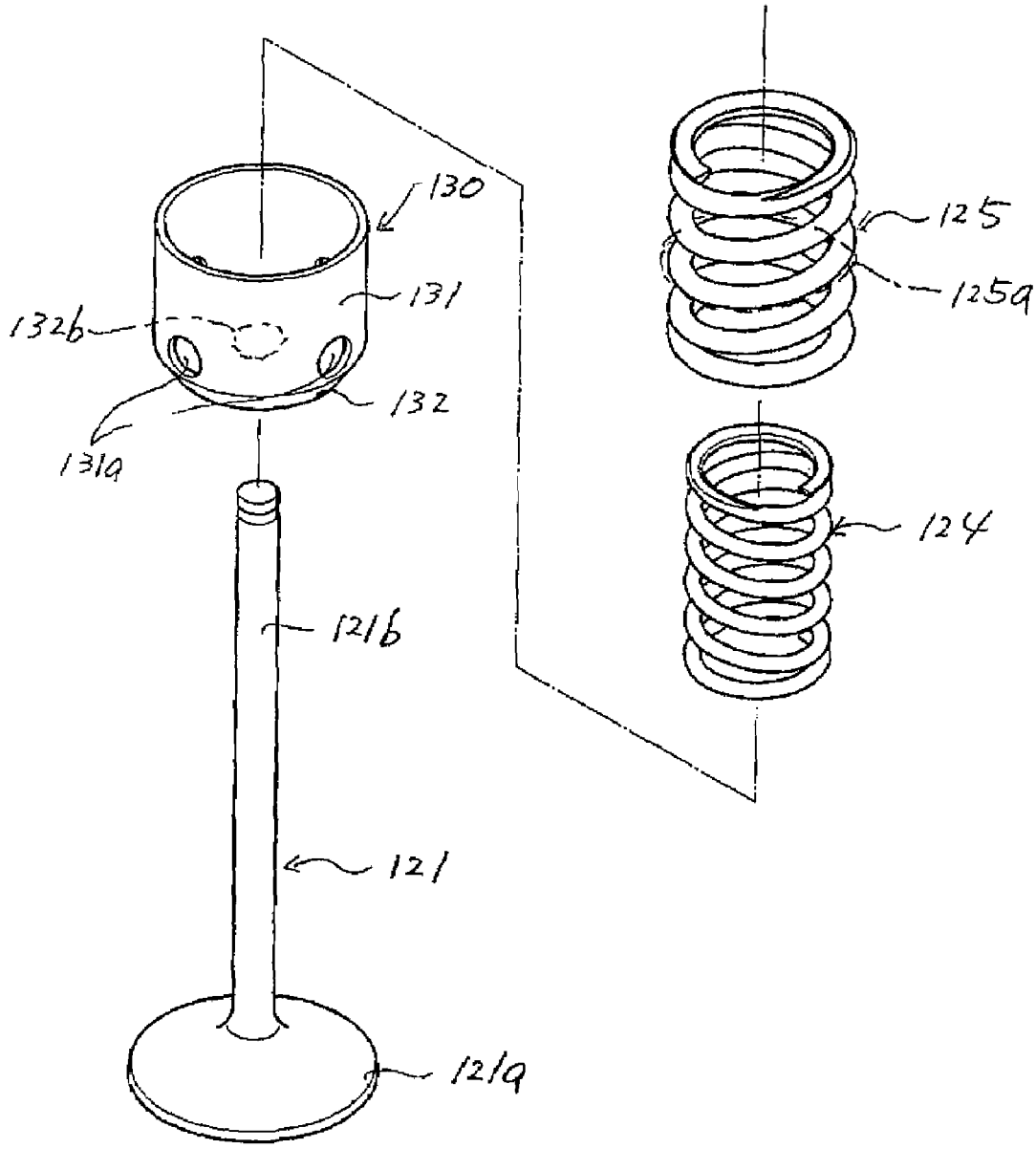

[FIG. 4]
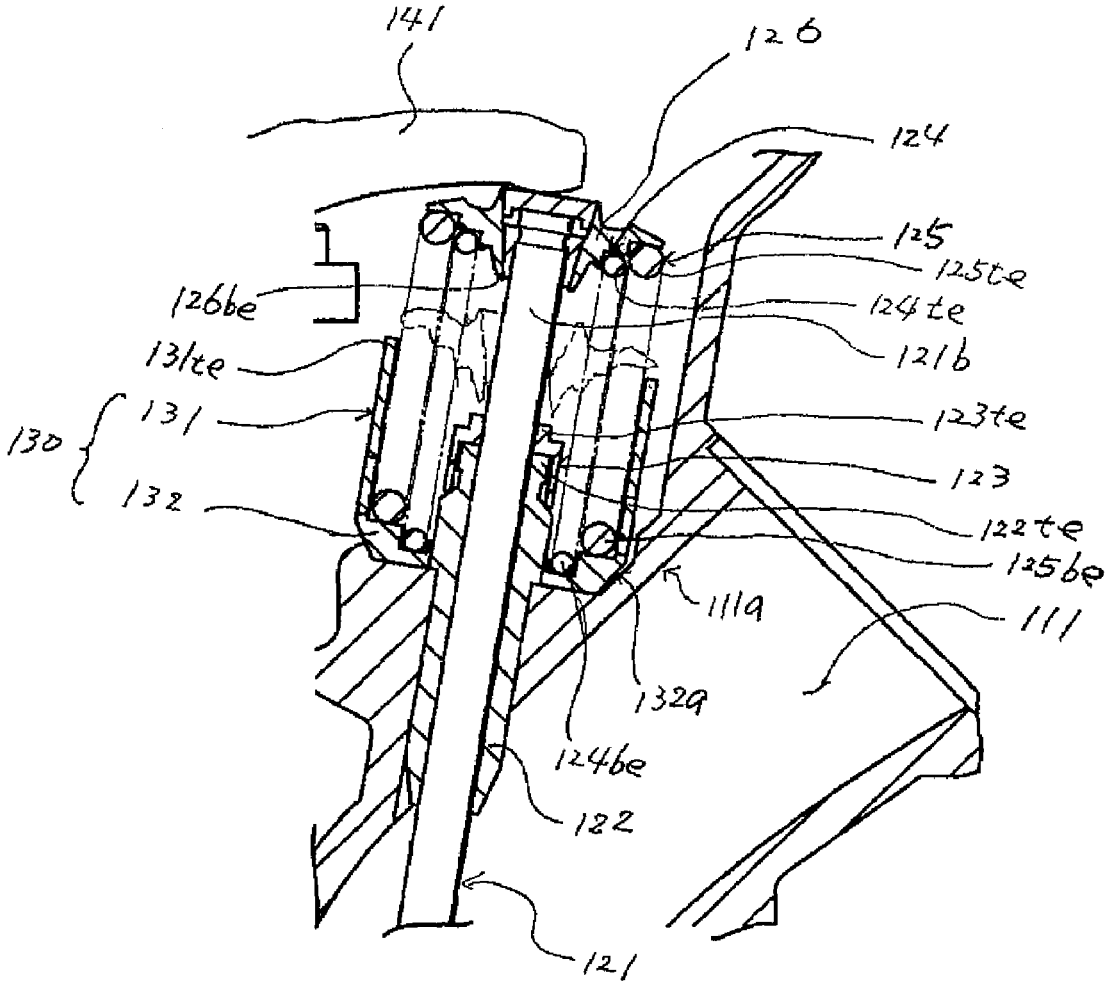

[FIG. 5]
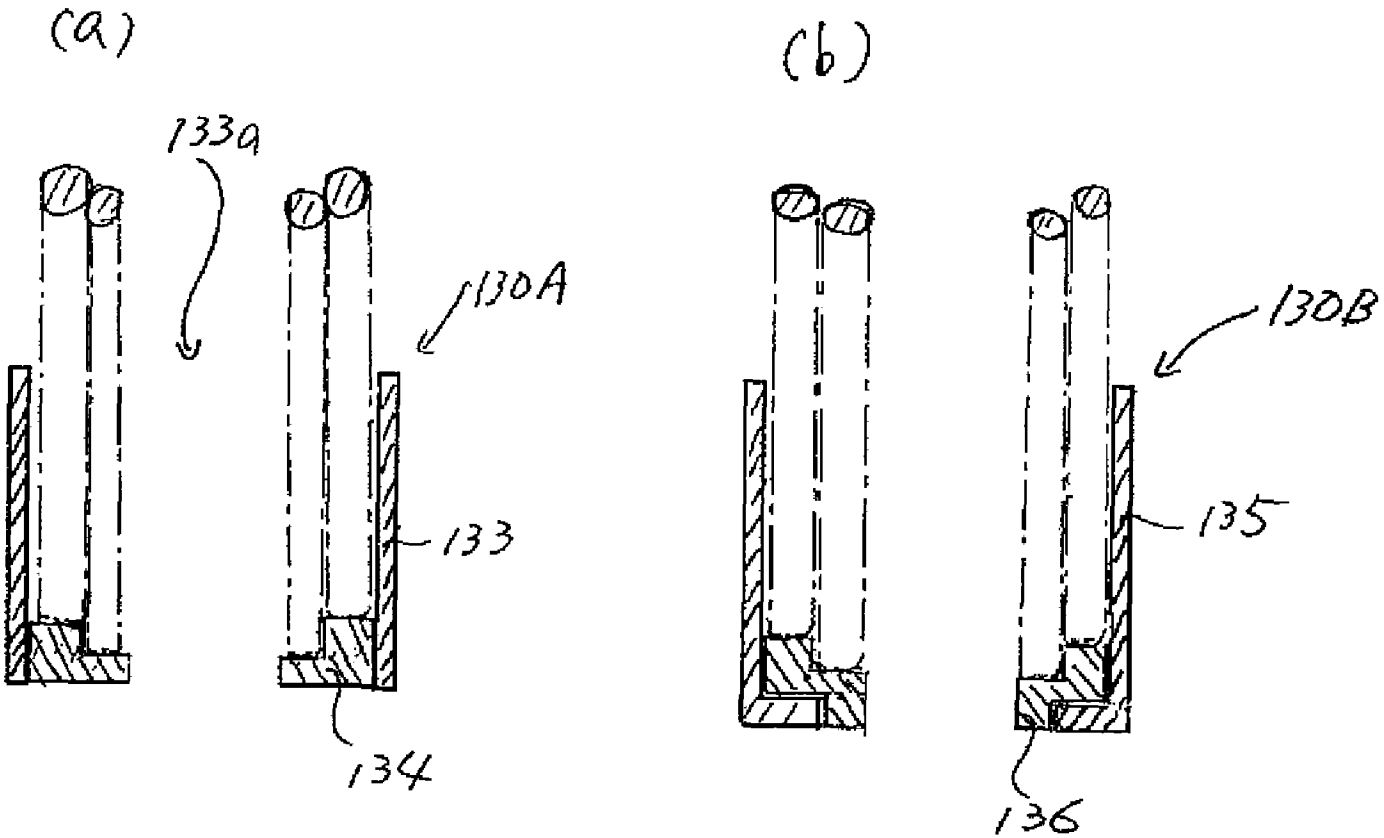

FOUR-CYCLE INTERNAL COMBUSTION ENGINE AND VEHICLE

RELATED APPLICATIONS

This application claims the benefit of priority under 35 USC 119 of Japanese patent application no. 2006-187272, filed on Jul. 6, 2006, which application is hereby incorporated by reference in its entirety.

BACKGROUND OF THE INVENTION

1. Field of the Invention

The present invention relates to a four-cycle internal combustion engine and, more particularly, relates to a high-revolution type four-cycle internal combustion engine mounted on a vehicle such as a sport type motorcycle.

2. Description of Related Art

In a four-cycle internal combustion engine used as a power source for a vehicle such as a motorcycle, a valve system is typically provided. The valve system typically includes a valve for opening/closing an intake port and an exhaust port (collectively referred to hereinafter as a "port") at a prescribed timing, and a coil valve spring for urging the valve in the direction that the port is closed.

A method for inhibiting abrasion of a valve spring in such an engine is known, in which spring seats are provided on both top and bottom ends of the valve spring in a contact manner. See, for example, JP-U-Hei 3-87905 (pages 4-6 and FIG. 1).

However, such valve systems have experienced problems in the case of high revolution speed in the engine (specifically, a crankshaft). In such high revolution speed, the speed of reciprocating motion of a valve is also high. If the speed of reciprocating motion of the valve increases, a valve spring pushed down by a locker arm (or a lifter) cannot contract straight, but instead contracts deformingly in the lateral direction (short side direction). Therefore, smooth operation of the valve is hindered and durability of the valve system is lowered.

SUMMARY OF THE INVENTION

The present invention provides a four-cycle internal combustion engine that improves durability of a valve system in the case of high revolution speed.

A four-cycle internal combustion engine according to the invention includes a cylinder head having a port. A valve has a fillet part and a stem part continuous with the fillet part for opening or closing the port. A valve spring urges the valve in a direction to close the port. A valve guide holds the stem part slidably. A tubular spring guide supports an outer periphery part of the valve spring. When the engine is disposed such that the cylinder head is positioned on the upper side, a top end of the spring guide is positioned above a top end of the valve guide.

In the four-cycle internal combustion engine of the invention, the tubular spring guide supports the outer periphery part of the valve spring, and the top end of the spring guide is positioned above the top end of the valve guide. Therefore, a situation where a coil valve spring cannot contract straight but contracts deformingly in a lateral direction (short side direction) is prevented, and thus improves durability of the valve system in the case of a high revolution speed.

Another feature of the invention is that the spring guide extends to a bottom end of the valve spring.

Another feature of the invention is a valve stem seal disposed above the valve guide for sealing the stem part, wherein the top end of the spring guide is positioned above a top end of the valve stem seal.

Another feature of the invention is a spring retainer that retains a top end of the valve spring, wherein the top end of the spring guide is positioned between the top end of the valve guide and a bottom end of the spring retainer.

Another feature of the invention is that the spring guide has a disc-shaped spring seat part contacting the bottom end of the valve spring.

Another feature of the invention is that the port is formed downward from the lateral side of the valve spring, and the spring guide has a disc-shaped spring seat part contacting the bottom end of the valve spring, and a rim part of the bottom end of the spring seat part is tapered downwardly.

Another feature of the invention is that the valve spring includes an inner spring and an outer spring into which the inner spring is inserted. A bottom end of the outer spring is positioned above a bottom end of the inner spring.

Another feature of the invention is an oil discharge port for discharging engine oil formed at a lower part of the spring guide.

Another feature of the invention is a vehicle provided with a four-cycle internal combustion engine as described above.

According to the present invention, a four-cycle internal combustion engine is provided that improves durability of a valve system in the case of high revolution speed.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is a left side view of a motorcycle according to an embodiment of the present invention.

FIG. 2 is a sectional view of a cylinder head of a four-cycle internal combustion engine according to an embodiment of the present invention.

FIG. 3 is an exploded perspective view of a valve system provided in the cylinder head of FIG. 2.

FIG. 4 is an enlarged sectional view of a spring guide according to an embodiment of the present invention and a vicinity of the spring guide.

FIG. 5 is a sectional view of a spring guide according to a variation example of the present invention.

DETAILED DESCRIPTION OF THE INVENTION

An embodiment of a four-cycle internal combustion engine according to the invention and a vehicle with the engine mounted is now described with reference to drawings.

In the following description of the drawings, same or similar reference numerals and symbols are provided to same or similar parts. Each drawing is a schematic diagram, and may include different dimensional ratios and the like from those of the actual parts. Hence, specific dimensions and the like should be determined in consideration of the following description. Furthermore, different drawings include elements which have different dimensional relations and ratios.

(General Schematic Structure of Vehicle with Four-Cycle Internal Combustion Engine Mounted)

FIG. 1 is a left side view of a motorcycle 10 with a four-cycle internal combustion engine 100 mounted according to the embodiment of the invention. Motorcycle 10 includes a front wheel 20 and a rear wheel 40 driven by an engine 100 as a power source. Specifically, a driving force produced by engine 100 is transmitted to rear wheel 40 via a transmission (not shown) and a drive chain 30. In one embodiment, motorcycle 10 is a sport type motorcycle suitable for high speed driving and driving on a winding road.

Engine 100 is a DOHC (dual overhead cams) type four-cycle internal combustion engine in which an intake camshaft 103 and an exhaust camshaft 104 are provided in a cylinder head 110 (see FIG. 2). A cam chain 102 is wrapped around intake camshaft 103, exhaust camshaft 104 and a crankshaft 101. Intake camshaft 103 and exhaust camshaft 104 are rotated as crankshaft 101 rotates. The preset maximum revolution speed is relatively high (for example, 10,000 rpm or higher).

(Structure of Four-Cycle Internal Combustion Engine)

Next, with reference to FIGS. 2-4, a structure of four-cycle internal combustion engine 100 is described.

(1) Structure of Cylinder Head

FIG. 2 is a cross-sectional view of cylinder head 110 of engine 100 along a direction perpendicular to crankshaft 101 (see FIG. 1) As shown in FIG. 2, cylinder head 110 has an intake port 111 for introducing a fuel-air mixture into a cylinder 160, and an exhaust port 112 for exhausting exhaust gas after combustion of the fuel-air mixture in cylinder 160. Intake port 111 and exhaust port 112 are collectively referred to as a "port" hereinafter.

Cylinder head 110 is provided with a valve system for opening/closing intake port 111 and exhaust port 112 at a prescribed timing. An intake valve 121 for opening or closing intake port 111 at a prescribed timing is disposed in intake port 11, and an exhaust valve 151 for opening or closing exhaust port 112 at a prescribed timing is disposed in exhaust port 112.

Intake valve 121 has a stem part 121*b* connecting to a fillet part 121*a*. Intake valve 121 is urged in a direction to close intake port 111 by an inner spring 124 and an outer spring 125, i.e., such that fillet part 121*a* blocks intake port 111. Inner spring 124 and outer spring 125 are collectively referred to as a "valve spring" hereinafter.

Intake valve 121 is pushed down by a locker arm 141 at a prescribed timing to open or close intake port 111. A cam 103*a* provided around intake camshaft 103 rotates and pushes locker arm 141 down. Exhaust valve 151 has a similar structure and is pushed down by a locker arm 142 at a prescribed timing to open or close exhaust port 112.

A valve guide 122, a valve stem seal 123 and a spring retainer 126 are disposed around stem part 121*b* of intake valve 121. Valve guide 122 holds stem part 121*b* slidably. Valve stem seal 123 is disposed above valve guide 122, and seals stem part 121*b*. Spring retainer 126 retains inner spring 124 and outer spring 125, and grips stem part 121*b*.

A spring guide 130 is also disposed in cylinder head 110. Spring guide 130 includes a guide part 131 and a spring seat part 132. Guide part 131 is tubular (more specifically, cylindrical) and supports an outer periphery part 125*a* of outer spring 125 (see FIG. 3). Spring seat part 132, which is disc-shaped and continuous with guide part 131, contacts a bottom end 124*be* of inner spring 124 and a bottom end 125*be* of outer spring 125.

Intake port 111 is formed downward from the lateral side of outer spring 125 so that an intake path to cylinder 160 is formed as straight as possible to reduce airflow resistance in the intake path through the inside of cylinder 160.

(2) Structure of Valve System

FIG. 3 is an exploded perspective view of a valve system provided in cylinder head 110, specifically, intake valve 121, inner spring 124, outer spring 125 and spring guide 130.

As shown in FIG. 3, fillet part 121*a* of intake valve 121 is disc-shaped. Stem part 121*b* is continuous with fillet part 121*a* and is inserted into a valve stem port 132*b* formed on spring seat part 132 of spring guide 130. Stem part 121*b* is also inserted into a hollow part of coil inner spring 124.

Outer spring 125 is formed into a coil similarly to inner spring 124. An inner diameter of outer spring 125 is slightly larger than an outer diameter of inner spring 124. Inner spring 124 is inserted into a hollow part of outer spring 125. Spring guide 130 supports outer periphery part 125*a* of outer spring 125. Specifically, an inner diameter of spring guide 130 is slightly larger than an outer diameter of outer spring 125. Outer spring 125 and inner spring 124 are inserted into guide part 131 of spring guide 130.

Spring guide 130 prevents outer spring 125 and inner spring 124 from contracting nonlinearly and deforming to the lateral side, that is, in the short side direction of outer spring 125. Therefore, to effectively prevent deformation of outer spring 125, an inner diameter of spring guide 130 is preferably as small as possible, with a clearance kept to an extent that contraction movement of outer spring 125 is not hindered.

An oil discharge port 131*a* for discharging engine oil flowing into spring guide 130 is formed at a lower part of guide part 131. In one embodiment, four oil discharge ports 131*a* are formed at intervals of approximately 90° in the vicinity of the border with spring seat part 132.

(3) Specific Structure of a Spring Guide

FIG. 4 is an enlarged sectional view of spring guide 130 and the vicinity of spring guide 130. As shown in FIG. 4, a top end 131*te* of spring guide 130 is positioned above a top end 122*te* of valve guide 122 and above a top end 123*te* of valve stem seal 123. In this regard, FIG. 4 shows a case where engine 100 is disposed such that cylinder head 110 is positioned on an upper side, specifically, a case that engine 100 is mounted on motorcycle 10 in a condition as shown in FIG. 1.

Also, top end 131*te* of spring guide 130 is positioned between top end 122*te* of valve guide 122 and a bottom end 126*be* of spring retainer 126 in a state that intake valve 121 closes intake port 111. As mentioned above, spring retainer 126 retains a top end 124*te* of inner spring 124 and a top end 125*te* of outer spring 125, while gripping stem part 121*b*. In a state that spring retainer 126 is pushed down by locker arm 141 and intake valve 121 opens intake port 111, bottom end 126*be* of spring retainer 126 (a valve cotter part) is positioned below top end 131*te* of spring guide 130.

Guide part 131 of spring guide 130 extends to bottom end 124*be* of inner spring 124 and bottom end 125*be* of outer spring 125, and continues to spring seat part 132. A rim part 132*a* of the bottom end of spring seat part 132 is chamfered and tapered downwardly. As shown in FIG. 4, in a cross section of cylinder head 110 along a direction perpendicular to crankshaft 101, an inner wall part 111*a* of intake port 111 on the side of spring seat part 132 is formed along an outline of rim part 132*a*.

Bottom end 125*be* of outer spring 125 is positioned above bottom end 124*be* of inner spring 124. Therefore, rim part 132*a* at the bottom end of spring seat part 132 can be formed into a downwardly tapered shape. Forming rim part 132*a* into a downwardly tapered shape allows the intake path to cylinder 160 (intake port 111) to be straighter.

(Function and Effect)

In engine 100, cylindrical spring guide 130 for supporting outer periphery part 125*a* of outer spring 125 is provided, and top end 131*te* of spring guide 130 is positioned above top end 122*te* of valve guide 122. Therefore, a situation is prevented where coil outer spring 125 and inner spring 124 cannot contract straight, but contract deformingly in a lateral (short side) direction. Preventing outer spring 125 from deformingly contracting improves durability of the valve system in the case of high revolution speed.

In the embodiment of the invention, spring guide 130 extends to bottom end 124*be* of inner spring 124 and bottom end 125*be* of outer spring 125, and continues to spring seat part 132. Top end 131*te* of spring guide 130 is positioned above top end 123*te* of valve stem seal 123. Thus, spring guide 130 allows outer periphery part 125*a* of outer spring 125 to be supported in a range as wide as possible, and allows deformation of outer spring 125 and inner spring 124 to be more effectively prevented.

In the embodiment of the invention, top end 131*te* of spring guide 130 is positioned between top end 122*te* of valve guide 122 and bottom end 126*be* of spring retainer 126. Therefore, top end 131*te* of spring guide 130 supports outer periphery part 125*a* of outer spring 125 while avoiding interference with spring retainer 126 pushed down by locker arm 141.

In the embodiment of the invention, spring guide 130 includes guide part 131 and spring seat part 132. Therefore, as compared with a case that guide part 131 and spring seat part 132 are formed as separate bodies, the assembling work for spring guide 130 is facilitated.

In the embodiment of the invention, rim part 132*a* of the bottom end of spring seat part 132 is tapered downwardly. Also, bottom end 125*be* of outer spring 125 is positioned above bottom end 124*be* of inner spring 124. Therefore, the intake path to cylinder 160 (intake port 111) can be formed straighter. When intake port 111 is formed into a straighter shape, airflow resistance in intake port 111 is lowered, so that a larger amount of fuel-air mixture is taken into cylinder 160 in a shorter period, thereby improving the output power of engine 100.

In the embodiment of the invention, an oil discharge port 131*a* is formed at a lower part of guide part 131 for discharging engine oil flowing into spring guide 130. Therefore, even in the case that outer periphery part 125*a* of outer spring 125 and inner spring 124 is covered by guide part 131, engine oil inside spring guide 130 is prevented from being stagnant.

OTHER EMBODIMENTS

While the invention has been described based on an embodiment, it should be understood that the description and the drawings do not limit the scope of this invention. Alternative embodiments based on the disclosure will be apparent to those skilled in the art.

For example, spring guide 130 can be modified as shown in FIGS. 5(*a*) and 5(*b*), which are schematic sectional views along a radial direction of a spring guide according to a variation example of the present invention. In a spring guide 130A shown in FIG. 5(*a*) and a spring guide 130B shown in FIG. 5(*b*), a guide part and a spring seat part are formed as separate bodies.

Spring guide 130A shown in FIG. 5(*a*) includes a guide part 133 and a spring seat part 134 press-fitted into an inner diameter part 133*a* of guide part 133. Spring guide 130B shown in FIG. 5(*b*) includes a guide part 135 and a spring seat part 136 engaged with guide part 135.

In the previously-described embodiment, rim part 132*a* of the bottom end of spring seat part 132 is tapered downwardly, and bottom end 125*be* of outer spring 125 is positioned above bottom end 124*be* of inner spring 124. However, rim part 132*a* of spring seat part 132 is not necessarily tapered downwardly, and bottom end 125*be* of outer spring 125 may not be positioned above bottom end 124*be* of inner spring 124.

In the previously-described embodiment, top end 131*te* of spring guide 130 is positioned between top end 122*te* of valve guide 122 and bottom end 126*be* of spring retainer 126. However, top end 131*te* of spring guide 130 may not be positioned between top end 122*te* of valve guide 122 and bottom end 126*be* of spring retainer 126, as long as top end 131*te* of spring guide 130 is positioned above top end 122*te* of valve guide 122.

Further, guide part 131 forming spring guide 130 may not extend to bottom end 124*be* of inner spring 124 and bottom end 125*be* of outer spring 125. For example, guide part 131 may be provided on a part of outer periphery part 125*a* including a center part in the vertical direction of outer spring 125, and guide part 131 may be supported not to move from the position. Also, in the above embodiment, inner spring 124 and outer spring 125 are used. However, the valve spring may be single. Further, spring guide 130 may be provided on the side of exhaust valve 151.

In the aforementioned embodiment, engine 100 is mounted on motorcycle 10. However, as a matter of course, the present invention may be applied to an engine mounted on a vehicle other than a motorcycle, such as a four-wheeled automobile.

The particular embodiments of the invention described in this document should be considered illustrative, rather than restrictive. Modification to the described embodiments may be made without departing from the spirit of the invention as defined by the following claims.

The invention claimed is:

1. A four-cycle internal combustion engine comprising:

a cylinder head having a port;

a valve having a fillet part and a stem part continuous with the fillet part for opening or closing the port;

a valve spring for urging the valve in a direction to close the port:

a valve guide for holding the stem part slidably;

a tubular spring guide for supporting an outer periphery part of the valve spring, wherein when the engine is disposed such that the cylinder head is positioned on an upper side, a top end of the spring guide is positioned above a top end of the valve guide; and a spring retainer for retaining a top end of the valve spring, wherein the top end of the spring guide is positioned between the top end of the valve guide and a bottom end of the spring retainer.

2. The four-cycle internal combustion engine according to claim 1, wherein the spring guide extends to a bottom end of the valve spring.

3. The four-cycle internal combustion engine according to claim 1, further comprising a valve stem seal disposed above the valve guide for sealing the stem part, wherein the top end of the spring guide is positioned above a top end of the valve stem seal.

4. The four-cycle internal combustion engine according to claim 1 wherein the spring guide comprises a disc-shaped spring seat part contacting the bottom end of the valve spring and a tubular guide part.

5. The four-cycle internal combustion engine according to claim 4, wherein the spring seat part is continuous with the guide part.

6. The four-cycle internal combustion engine according to claim 1 wherein the port is formed downward from the lateral side of the valve spring, and a rim part of the bottom end of the spring seat part is tapered downwardly.

7. A motorcycle provided with the four-cycle internal combustion engine according to claim 1.

8. The A four-cycle internal combustion engine comprising:

a cylinder head having a port;

a valve having a fillet part and a stem part continuous with the fillet part for opening or closing the port;

a valve spring for urging the valve in a direction to close the port;

a valve guide for holding the stem part slidably; and a tubular spring guide for supporting an outer periphery part of the valve spring, wherein when the engine is disposed such that the cylinder head is positioned on an upper side, a top end of the spring guide is positioned above a top end of the valve guide, the spring guide comprises a disc-shaped spring seat part contacting the bottom end of the valve spring and a tubular guide part, and the spring seat part and guide part are formed as separate bodies.

9. The four-cycle internal engine according to claim 8, wherein the spring seat part is press-fitted into an inner diameter part of the guide part.

10. A four-cycle internal combustion engine comprising:

a cylinder head having a port;

a valve having a fillet part and a stem part continuous with the fillet part for opening or closing the port;

a valve spring for urging the valve in a direction to close the port;

a valve guide for holding the stem part slidably; and a tubular spring guide for supporting an outer periphery part of the valve spring, wherein when the engine is disposed such that the cylinder head is positioned on an upper side, a top end of the spring guide is positioned above a top end of the valve guide, the port is formed downward from the lateral side of the valve spring, and a rim part of the bottom end of the spring seat part is tapered downwardly, and the valve spring has an inner spring and an outer spring into which the inner spring is inserted, and a bottom end of the outer spring is positioned above a bottom end of the inner spring.

11. The A four-cycle internal combustion engine comprising:

a cylinder head having a port;

a valve having a fillet part and a stem part continuous with the fillet part for opening or closing the port;

a valve spring for urging the valve in a direction to close the port;

a valve guide for holding the stem part slidably; and a tubular spring guide for supporting an outer periphery part of the valve spring, wherein when the engine is disposed such that the cylinder head is positioned on an upper side, a top end of the spring guide is positioned above a top end of the valve guide, and an oil discharge port for discharging engine oil is formed at a lower part of the spring guide.

* * * * *